US005860520A

United States Patent [19]

Tang

[11] Patent Number: 5,860,520

[45] Date of Patent: Jan. 19, 1999

[54] GOLF CLUB BAG WITH CLUB SEPARATOR

[75] Inventor: Larry Tang, Westlake Village, Calif.

[73] Assignee: Taylor Made Golf Company, Inc., Carlsbad, Calif.

[21] Appl. No.: 787,111

[22] Filed: Jan. 22, 1997

[51] Int. Cl.[6] ..... A63B 55/00

[52] U.S. Cl. ..... 206/315.6; 206/315.3; 206/315.5

[58] Field of Search ..... 206/315.3–315.8

[56] References Cited

U.S. PATENT DOCUMENTS

| | | | |
|---|---|---|---|
| 1,483,475 | 2/1924 | Osterhoudt | 206/315.6 |
| 2,607,382 | 8/1952 | Le Vine | 206/315.6 |
| 2,879,819 | 3/1959 | Turnbull | 150/160 X |
| 4,596,328 | 6/1986 | Solheim | 206/315.6 |
| 4,667,820 | 5/1987 | Solheim | 206/315.6 |
| 4,881,638 | 11/1989 | Cho | 206/315.6 X |
| 4,949,844 | 8/1990 | Yang | 206/315.3 X |
| 5,103,974 | 4/1992 | Antonious | 206/315.6 |
| 5,123,531 | 6/1992 | Beretta | 206/315.6 X |
| 5,135,107 | 8/1992 | Ingraham | 206/315.6 |
| 5,228,566 | 7/1993 | Shenoha | 206/315.6 |
| 5,458,240 | 10/1995 | Rich et al. | 206/315.6 X |
| 5,624,028 | 4/1997 | Shin et al. | 206/315.6 |

FOREIGN PATENT DOCUMENTS

| | | |
|---|---|---|
| 324771 | 2/1930 | United Kingdom . |
| 2266670 | 11/1993 | United Kingdom . |

*Primary Examiner*—Sue A. Weaver
*Attorney, Agent, or Firm*—Greenblum & Bernstein, P.L.C.

[57] ABSTRACT

The invention relates to a golf club bag adapted for the storage of a set of golf clubs including an elongated tubular main element, a rigid lower base element connected to the lower end of the elongated tubular element adapted to rest on a horizontal surface to maintain the bag in an upright position, a rigid upper base element connected to the upper end of the elongated tubular element. The upper base element includes a first upper portion having a main opening and a second lower portion lowered with respect to the first portion and having a second opening whose cross-section is smaller than the cross-section of the main opening of the upper portion, in order to be adapted to the storage of at least one golf club that is shorter than the average length of the clubs composing the set of golf clubs.

22 Claims, 2 Drawing Sheets

GOLF CLUB BAG WITH CLUB SEPARATOR

BACKGROUND OF THE INVENTION

1. Field of the Invention

The present invention relates to the field of golf club bags. The invention relates more particularly, but not exclusively, to an improvement to a golf club bag adapted to be carried by a motorized vehicle commonly referred to as golf cart.

2. Background and Material Information

The function of a golf bag is to gather a series of golf clubs and make them available to the player, so that the latter can select the most adapted club for each stroke.

In view of the substantial weight of a bag containing a complete set of clubs and the magnitude of the distance to be covered, golfers have widely utilized motorized vehicles over the past few years. In addition, this carrying or transportation means has enabled golf to become, or remain, accessible to a greater number of people.

The golf bag is generally arranged in a vertical position and on a platform of the cart that is slightly raised with respect to the ground. Generally, the bag is properly held in place on the cart by means of straps, i.e., preferably on a lateral side of the bag, in order to maintain access to pockets or various compartments containing accessories such as balls, tees, towels, etc. Consequently, the clubs are not readily accessible, because it is necessary to lift them over a certain height to retrieve them. Moreover, the clubs often get mixed up in the bag, some of them being moved to the least accessible side, which renders the selection difficult for the player whose attention must be entirely focused on the game.

In particular, the putter is the club that is statistically mostly used in a golf game, since it is generally selected to hole out. Generally, this club 's also the shortest in the series and is, therefore, the most difficult to find among the other clubs (irons, woods, . . . ) in the bag, and to retrieve therefrom.

U.S. Pat. No. 5,123,531 relates to a bag shapes so as to be used on a golf cart, which includes a bag head whose edge has a slope which makes it easy to see and extract the clubs. However, this presentation is not completely satisfactory and it forces the player to be strict when storing these clubs. In addition, the putter appears to be placed in the midst of other clubs without any specific distinctive arrangement.

U.S. Pat. No. 1,483,475, issued in 1924, relates to a construction of a portable golf bag which includes two compartments completely separated along the entire length of the bag to separate the wooden clubs from the iron clubs, the iron clubs being capable of damaging the connection of the wooden club heads. It is obvious that this is no longer a present-day problem and that the construction of a bag double structure is expensive, weighs down the bag and does not satisfactorily address the problem of the present invention.

U.S. Pat. No. 1,915,889 is related to a bag including a single separation flexible strip to isolate the woods from the irons, and does not either constitute a good solution to the problem which the present invention proposes to resolve.

SUMMARY OF THE INVENTION

One of the main objects of the golf bag of the invention is to improve the availability of the clubs, in general, and of the putter, in particular, by isolating it from the remainder of the series and, at the same time, by facilitating access to this particular club that is used more frequently. It is understood that facilitating the search for one of the clubs in the series will also clearly facilitate the search for the other clubs.

Another object of the invention is to facilitate the extraction of the putter out of the bag, but a to facilitate the repositioning thereof in the bag at the end of each hole; this is the period during which it is frequently necessary to rapidly clear the green for the next group of players. The player can have a longer actual playing time, or play faster when necessary.

Still another object of the invention is to enable the player to see immediately that his or her putter is correctly repositioned and available once again in the bag; this limits the instances where the club is lost or forgotten on the green.

To achieve the aforementioned various objects, the invention relates to a golf club bag adapted for the storage of a set of golf clubs including an elongated tubular main element, a rigid lower base element connected to the lower end of the elongated tubular element adapted to rest on a horizontal surface to maintain the bag in an upright position, and a rigid upper base element connected to the upper end of the elongated tubular element. This upper base element includes a first upper portion having a main opening and a second lower portion lowered with respect to the first portion and having a second opening whose cross-section is smaller than the cross-section of the main opening of the upper portion, in order to be adapted to the storage of at least one golf club that is shorter than the average length of the clubs composing the set of golf clubs. It is to be understood that with such a solution, one can thus easily isolate a frequently used short club, such as a putter, for example, and thus facilitate its search, extraction and repositioning in the bag.

More specifically, the second lower portion includes an opening formed by a single hole adapted for the introduction of a single golf club of the putter type.

BRIEF DESCRIPTION OF THE DRAWINGS

Other characteristics and advantages of the invention will become apparent from the following description, with reference to the drawings of a preferred embodiment of the invention, in which.

DETAILED DESCRIPTION OF THE PREFERRED EMBODIMENTS

Figure 1:
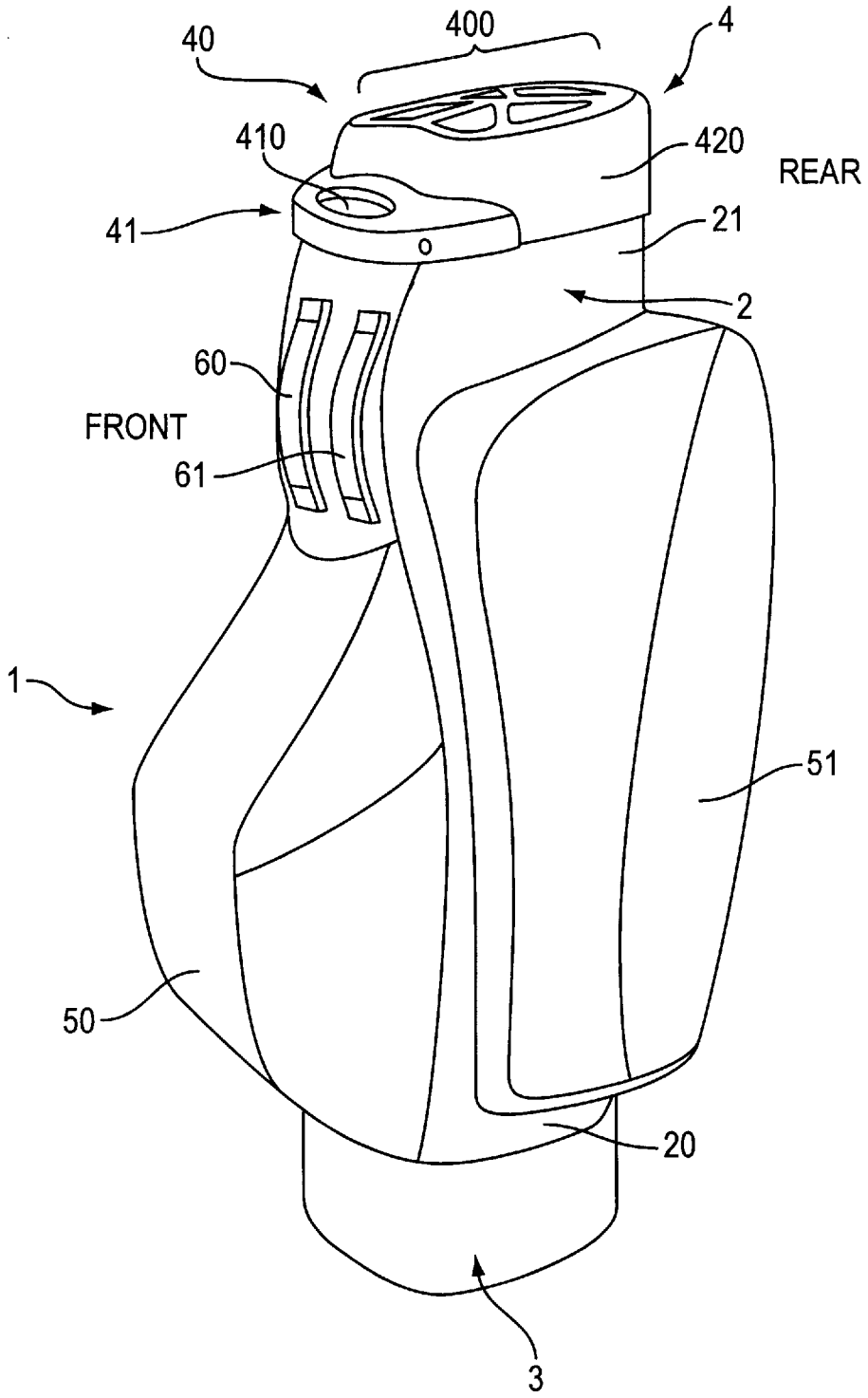
FIG. 1 is a general perspective view of a golf club bag according to the invention.

With reference to FIG. 1 showing the general and main characteristics of the invention, the golf bag 1 includes an elongate tubular element 2 to which a lower base element or rigid bottom 3 is connected, at the lower end 20 of the tubular element 2, on the one hand, and an upper base element or rigid flange 4 is connected to the upper end 21 of the tubular element 2. The references "upper" and "lower" are used for a better understanding of the invention and with respect to the vertical, in view of the upright position of the bag. However, these terms cannot limit the scope of the invention as a function of the presentation thereof into space.

The rigid tubular element is composed of a peripheral wall generally made of sufficiently rigid materials, such as plastics, for example, and covered with decorative materials made of textile, flexible plastic, leather or the like.

The bag further includes an assembly of storage compartments 50, 51 provided with pockets for holding accessories such as balls, tees, gloves, etc.

For a golf bag adapted to be carried vertically by a motorized cart, it is important to define a front side (FRONT) and a rear side (REAR) in view of the positioning on the platform of the cart. Generally, the front portion is that which remains visible, while the rear portion is hidden and serves as a support against the cart. The bag is normally maintained in position against the cart by one or more straps (not shown). The front portion of the bag is identified by the presence of the storage compartment 50 which protrudes with respect to the tubular main element 2. When in position on the cart, the lateral side of the bag can remain accessible and thus include a narrower but elongate storage compartment 51. On the other hand, the rear side of the bag has a very small number of compartments or pockets, if any, in view of the resulting bulkiness which would hinder the storing on the cart and of the lack of accessibility from the rear side of the bag.

To allow a better grip of the bag, it is useful to have handles 60, 61 arranged in the longitudinal direction of the tubular element and fixed thereto, of course, on ton front side of the bag. In an alternate embodiment, a single handle can be used instead of the two laterally spaced apart handles 60, 61 shown in FIG. 1.

According to an important characteristic of the invention, the upper base element 4 includes a first upper portion 40 defining a main opening 400, and a second upper portion 41, which is distinct from the first and has the particularity of having a second opening 410 lowered with respect to the main opening 400 of the first portion 40. In other words, the opening 410 is located at a distinctly lower level than that of the main opening 400 whose cross section is greater than the cross section of the opening 410.

Thus, the function of the second opening 410 is preferably to receive a single short club which is generally selected from the line of the most frequently used putters in the series. The main opening is used For receiving the remainder of the series, namely, the numbered irons, the wedges, the woods as well as the various accessories such as scoop net, for example.

The secondary opening 410 is advantageously located on the front side (FRONT) of the bag for accessibility.

Figure 2:
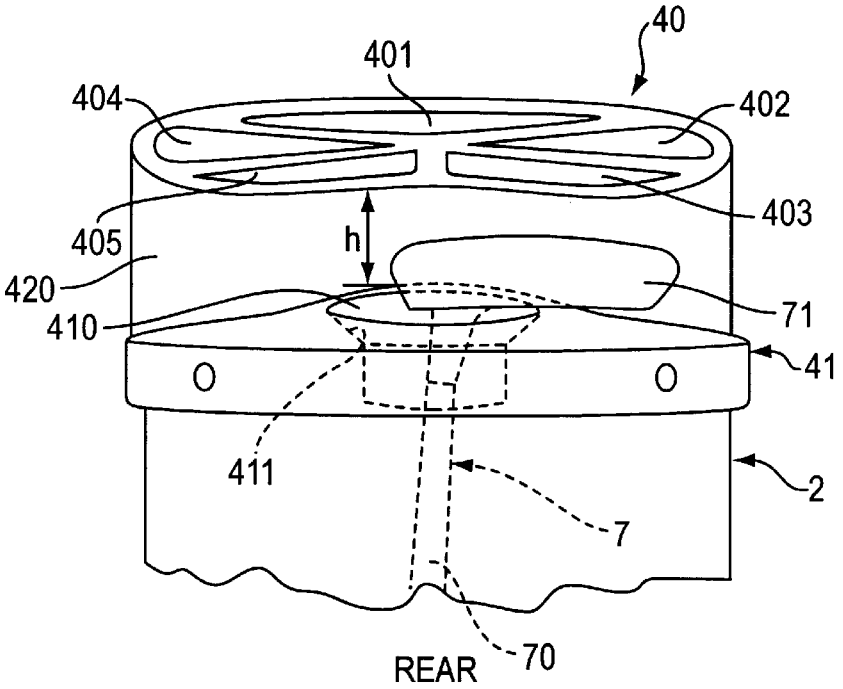
FIG. 2 is a partial view of the front of the head of the bag according to the invention.
Figure 3:
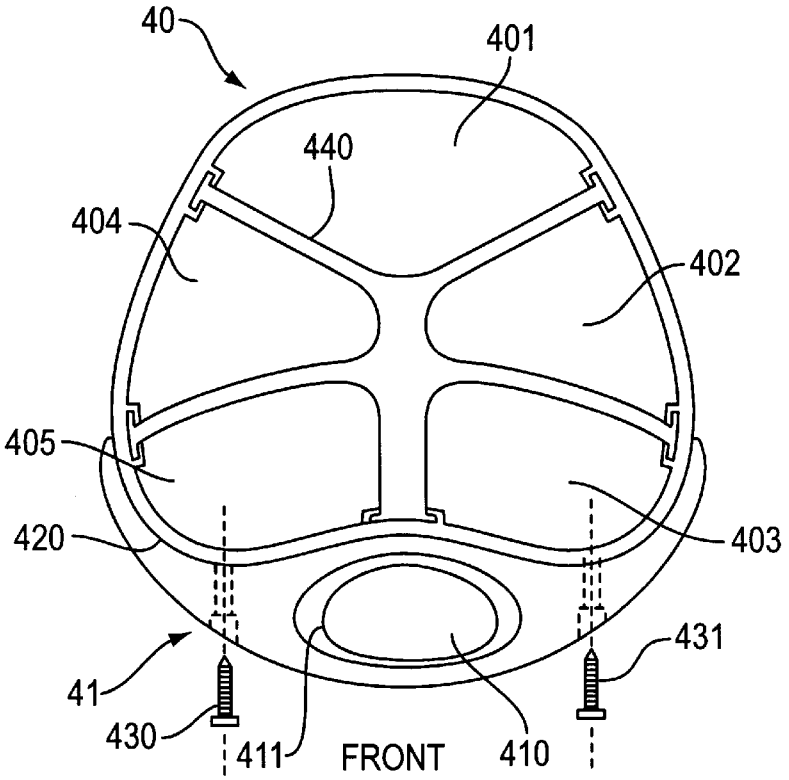
FIG. 3 is a top view of the bag according to the invention.

As shown in FIGS. 2 and 3, the opening 410 is a hole which can be adapted for the introduction of a single putter. However, the invention cannot be limited to a single hole and also encompasses the provision of a plurality of distinct holes to arrange a plurality of clubs with a short shaft. The hole 410 could also include a wall to separate two clubs for example. Preferably, the hole includes an internal edge portion 411 which flares out towards the exit of the hole.

FIG. 2 also shows the arrangement according to the preferred embodiment of a putter-type club 7 including a shaft 70 inserted within the tubular main element and a head 71 which extends sufficiently beyond the opening 410. The position of the opening is determined such that on the average, the head of a conventional putter is located beneath the level of the lowermost portion of the main opening 400, in order not to hinder the access to the other clubs.

Thus, preferably, the first portion 40 also includes a substantially vertical peripheral external edge or surface 420 which has an exposed portion with a height h equal to at least several centimeters from the secondary opening 410. This height is on the average comprised between, and can range from approximately 3 to 15 cm. The shape of the hole 410 is preferably flattened in the main front/rear direction, so as to limit the bulkiness of the second upper portion and to facilitate its integration into the bag. As can be seen in FIG. 3, the peripheral external surface 420 of the first upper portion 40 defines an area that is greater than the area of the second upper portion 41. Further, FIG. 2 shows that the uppermost or top surface of the second upper portion 41 is lower than the uppermost or top surface of the first upper portion 40.

As shown more clearly in FIG. 3, the first portion 40 preferably has an opening 400 formed of a plurality of separated compartments 401, 402, 403, 404, 405, adapted to receive the remainder of the set of clubs in a selected order.

It must be noted that the upper surface of the first portion 40 is advantageously slightly inclined with respect to a horizontal plane when the bag rests in an upright vertical position on its lower base element 3. The inclination of this surface is oriented such that the lowermost portion is located on the same side as the second upper portion 41, i.e., on the front side (FRONT) of the bag. Thus, the longest clubs are positioned in the compartment(s) located at the rear of the bag and, as the clubs become shorter in the set, they are progressively arranged toward the front of the bag.

FIG. 3 shows a preferred construction mode in which the second upper portion 41 is formed by a separated element attached against the peripheral edge 420 of the first portion 40. This separated element is assembled, for example, by means of screws 430, 431, passing through the element and anchored in the wall of the first portion 40.

Of course, other appropriate connection means, such as riveting, clipping assembling, or gluing by means of an adhesive, can be utilized.

The element could also be assembled directly on the tubular main element 2, and not on the upper portion 40, or it could be anchored on both at the same time.

An interesting alternative solution consists of providing the second upper portion 41 to be obtained as a monoblock with respect to the peripheral edge 420 of the first portion 40. Thus, using a molding technique by plastic injection, it is possible to obtain the peripheral edge and the second portion 41 in a single plastic piece. The assembly can then be connected to the tubular element by any appropriate connection means.

FIG. 3 also shows that the separated compartments 401–405 of the first upper portion are formed by a separation element 440 attached through the main opening having a plurality of arms which form substantially vertical separation walls. The end of each arm is connected to the internal surface of the first upper portion.

The connection of each end of the separation element on the bag can advantageously consists of a slide, such end having the shape of a slide bar which cooperates in rail-shaped grooves present on the internal surface of the first upper portion.

Of course, the golf bag of the invention could also be adapted to be carried by various carrying devices like a pull cart, for example, without departing from the scope of the invention.

The scope of the invention is not limited to the embodiment that has just been described as best embodiment, but it extends to any device that falls within the scope of the following claims.

What is claimed is:

1. A golf club bag adapted for the storage of a set of golf clubs comprising:

an elongated tubular main element having an upper end and a lower end, the elongated tubular main element further having a rear side and an opposing front side, thereby defining a front side and a rear side of the golf club bag, the front side of the elongated tubular main element including at least one handle protruding with respect to the elongated tubular main element;

a rigid lower base element connected to the lower end of the elongated tubular main element adapted to rest on a horizontal surface to maintain the bag in an upright position;

a rigid upper base element connected to the upper end of the elongated tubular main element;

said upper base element comprising:

a first upper portion having a main opening delimited circumferentially by a continuous peripheral external edge; and a second upper portion having a second opening, the second upper portion having a cross section that is smaller than a cross section of the first upper portion, the second upper portion being lowered with respect to the first upper portion, and the second upper portion being positioned against said peripheral external edge of said first upper portion at least at said front side of the golf club bag so as to leave an exposed portion of said peripheral edge.

2. A golf club bag according to claim 1, wherein the second upper portion includes an opening formed by a single hole adapted for the introduction of a single golf club of the putter type.

3. A golf club bag according to claim 2, wherein the hole comprises an internal edge portion that flares out toward the exit of the hole.

4. A golf club bag according to claim 2, wherein the first upper portion comprises an opening formed of a plurality of separated compartments adapted to receive the remainder of a set of golf clubs.

5. A golf club bag according to claim 4, wherein the separated compartments of the first upper portion are formed by a separation element attached through the main opening having a plurality of arms forming substantially vertical separation walls; the end of each being connected to the internal surface of the first upper portion.

6. A golf club bag according to claim 1, wherein the first upper portion comprises an upper surface and a substantially vertical peripheral external edge having an exposed portion having a predetermined height with respect to the second upper portion.

7. A golf club bag according to claim 6, wherein the second upper portion is made monoblock with respect to the peripheral edge of the first portion.

8. A golf club bag according to claim 6, wherein the upper surface of the first portion is slightly inclined with respect to the horizontal when the bag rests in an might position on the lower base element, the inclination of the surface being oriented such that the lowermost portion is located on the same side as the second upper portion.

9. A golf club bag according to claim 6, wherein the predetermined height is within a range of approximately 3 to 15 centimeters.

10. A golf club bag according to claim 6, wherein the second upper portion is formed by a separated portion attached against the peripheral edge of the first upper portion.

11. A golf club bag according to claim 10, wherein said separated element is connected to said first upper portion by means of a mechanical connection.

12. A golf club bag according to claim 11, wherein said mechanical connection comprises at least one of screws, rivets, a clipping assembly, and adhesive.

13. A golf club bag according to claim 1, wherein the front side includes at least one storage compartment protruding with respect to the elongated tubular main element.

14. A golf club bag according to claim 13, wherein said at least one storage compartment is positioned beneath said at least one handle.

15. A golf club bag according to claim 1, wherein said at least one handle comprises two laterally spaced apart handles.

16. A golf club bag adapted for the storage of a set of golf clubs comprising:

an elongated tubular element having an upper end, a lower end, a front side and a rear side, thereby defining a front side and a rear side of the golf club bag, and at least one handle positioned on the front side of the elongated tubular element;

a lower base element connected to the lower end of the elongated tubular element adapted to rest on a horizontal surface to maintain the bag in an upright position;

an upper base element connected to the upper end of the elongated tubular element;

said upper base element comprising:

a first upper portion having an opening delimited circumferentially by a peripheral external surface, thereby defining a certain area, said opening having a size adapted to receive a plurality of the set of golf clubs, said plurality including irons and woods; and a second upper portion having at least a second opening, the second upper portion defining an area less than said certain area of said first upper portion, the second upper portion being positioned externally of the peripheral external surface of the first upper portion at least at the front side of the golf bag, and the second upper portion being positioned lower than the first upper portion, whereby a portion of the peripheral surface extends between the first upper portion and the second upper portion.

17. A golf club bag according to claim 16, wherein the portion of the peripheral surface extending between the first upper portion and the second upper portion has a height of approximately 3 to 15 centimeters.

18. A golf club bag according to claim 16, further comprising a separation element positioned within the opening of first upper portion, thereby defining a plurality of compartments for receiving golf clubs.

19. A golf club bag according to claim 16, wherein the at least a second opening of the second upper portion consists of a single opening having a size adapted to receive only a single golf club.

20. A golf club bag according to claim 16, wherein the first upper portion has a top surface, wherein the second upper portion has a top surface, and wherein the top surface of the second portion is lower than every part of the top surface of the first portion.

21. A golf club bag according to claim 16, further comprising at least one storage compartment positioned on the front side of the elongated tubular element beneath said at least one handle.

22. A golf club bag according to claim 16, wherein said at least one handle comprises two laterally spaced apart handles.

* * * * *